US012497733B2

(12) United States Patent
Wang et al.

(10) Patent No.: US 12,497,733 B2
(45) Date of Patent: Dec. 16, 2025

(54) METHOD FOR PREJUDGING YARN DYEING PERFORMANCE, ELECTRONIC DEVICE AND STORAGE MEDIUM

(71) Applicant: ZHEJIANG HENGYI PETROCHEMICAL CO., LTD., Zhejiang (CN)

(72) Inventors: Peng Wang, Zhejiang (CN); Xiantao Peng, Zhejiang (CN); Yibo Qiu, Zhejiang (CN); Mingyi Liu, Zhejiang (CN); Dandan Wang, Zhejiang (CN); Junliang Jin, Zhejiang (CN); Jun Shen, Zhejiang (CN); Xuan Wu, Zhejiang (CN)

(73) Assignee: Zhejiang Hengyi Petrochemical Co., Ltd., Zhejiang (CN)

( * ) Notice: Subject to any disclaimer, the term of this patent is extended or adjusted under 35 U.S.C. 154(b) by 0 days.

(21) Appl. No.: 18/956,134

(22) Filed: Nov. 22, 2024

(65) Prior Publication Data

US 2025/0207324 A1 Jun. 26, 2025

(30) Foreign Application Priority Data

Dec. 21, 2023 (CN) ..... 202311773984.2

(51) Int. Cl.
*D06P 1/00* (2006.01)

(52) U.S. Cl.
CPC ..... *D06P 1/0032* (2013.01)

(58) Field of Classification Search
None
See application file for complete search history.

(56) References Cited

U.S. PATENT DOCUMENTS 5,850,623 A 12/1998 Carman, Jr. et al.
9,797,070 B1 10/2017 Newton et al.
(Continued)

FOREIGN PATENT DOCUMENTS

CN 105606563 A 5/2016
CN 105699319 A 6/2016
(Continued)

OTHER PUBLICATIONS

CN108595744A translation (Year: 2018).*
(Continued)

*Primary Examiner* — Lina Cordero
(74) *Attorney, Agent, or Firm* — Akerman LLP

(57) ABSTRACT

Provided is a method for prejudging yarn dyeing performance, an electronic device and a computer-readable storage medium. The method includes: determining a yarn normally dyed for a yarn to be judged; performing spectral detection on the yarn normally dyed to obtain first spectral information; calculating a covariance by simulation through a Gaussian process kernel; obtaining a plurality of pieces of continuous second spectrum information for the yarn to be judged, and establishing a Gaussian process regression model; obtaining third spectrum information for a yarn to be detected; performing a subtraction operation on the third spectral information and the second spectral information; and judging the yarn dyeing performance according to a matrix value obtained by the subtraction operation.

20 Claims, 2 Drawing Sheets

(56) References Cited

U.S. PATENT DOCUMENTS

| | | | | |
|---|---|---|---|---|
| 2003/0063256 | A1* | 4/2003 | Inuzuka | B29D 11/00009 351/159.66 |
| 2010/0191493 | A1* | 7/2010 | Brown | G01N 21/359 702/181 |
| 2010/0195903 | A1* | 8/2010 | Tani | G06V 20/693 382/162 |
| 2019/0310207 | A1 | 10/2019 | Guzman Cardozo | |

FOREIGN PATENT DOCUMENTS

| | | | | |
|---|---|---|---|---|
| CN | 107247045 | A | 10/2017 | |
| CN | 108595744 | A | 9/2018 | |
| CN | 109115701 | B | 1/2019 | |
| CN | 109324013 | A | 2/2019 | |
| CN | 112649391 | A | 4/2021 | |
| CN | 113158935 | A | 7/2021 | |
| CN | 113536687 | A | 10/2021 | |
| CN | 114092784 | A | 2/2022 | |
| CN | 114252401 | A | 3/2022 | |
| CN | 115630332 | A | 1/2023 | |
| CN | 116343032 | A | 6/2023 | |
| CN | 116796159 | | 9/2023 | |
| CN | 219777482 | U | 9/2023 | |
| DE | 102017219492 | A1 | 5/2019 | |
| EP | 1010000 | B1 | 10/2003 | |
| JP | H09068466 | A | 3/1997 | |
| JP | 2016-117979 | A | 6/2016 | |
| WO | WO-9841825 | A1 * | 9/1998 | G01J 3/44 |
| WO | WO-9912019 | A1 * | 9/1999 | G01N 21/65 |
| WO | 2019/142718 | A1 | 11/2020 | |
| WO | 2022116594 | A1 | 6/2022 | |

OTHER PUBLICATIONS

Notification of the First Office Action and Search Report dated Feb. 6, 2024, issued in connection with Chinese Patent Application No. 202311773984.2.

Notification on Grant of the Patent Right for Invention dated Mar. 8, 2024, issued in connection with Chinese Patent Application No. 202311773984.2.

He et al., "Outlier Detection of Power Transformer Oil Chromatographic Data Based on Algorithm Sliding Windows and Multivariate Gaussian Distribution," High Voltage Apparatus, Jan. 16, 2020, vol. 56, No. 1, pp. 203-209.

Axell et al., "Spectrum Sensing of Signals with Structured Covariance Matrices Using Covariance Matching Estimation Techniques," Jan. 19, 2012, IEEE.

Extended European Search Report issued May 13, 2025 in connection with corresponding European Patent Application No. 24215949.9.

Office Action issued Jan. 28, 2025 in connection with corresponding Japanese Patent Applicaion No. 2024-225103.

Notice of Reasons for Refusal issued Jun. 19, 2025 in connection with corresponding Japanese Patent Application No. 2024-225103.

* cited by examiner

METHOD FOR PREJUDGING YARN DYEING PERFORMANCE, ELECTRONIC DEVICE AND STORAGE MEDIUM

CROSS-REFERENCE TO RELATED APPLICATIONS

The present application claims priority to Chinese Patent Application No. CN202311773984.2, filed with the China National Intellectual Property Administration on Dec. 21, 2023, the disclosure of which is hereby incorporated herein by reference in its entirety.

TECHNICAL FIELD

The present disclosure relates to the field of intelligent manufacture, and in particular to an intelligent detection technology for yarn dyeing performance.

BACKGROUND

In the manufacturing process of yarns used for spinning and printing (such as polyester filament yarns), dyeing performance is usually judged by random inspection after the yarns are wound into yarn spindles and subsequently doffed. Detection is usually performed using a manual hosiery dyeing method. However, the method has defects of lag and large errors in manual judgment, failing to timely identify products with unqualified dyeing performance during operation of the production line, so that the manufacturer cannot adjust production conditions in time, thereby resulting in an increase of defective products, a decline in product quality, and affecting product sales grade. In addition, the manual random inspection method has the possibility of missed detection and missed judgment, which causes economic losses to downstream manufacturers.

Therefore, the industry urgently needs a detection method that can accurately, timely and completely detect dyeing performance of online yarns.

SUMMARY

The present disclosure provides a method and apparatus for prejudging yarn dyeing performance, an electronic device and a computer-readable storage medium, so as to timely judge dyeing performance of yarns in a simple and reliable manner.

According to a first aspect of the present disclosure, provided is a method for prejudging yarn dyeing performance, including:

determining a yarn sample normally dyed in a same batch for a yarn sample to be judged;

performing spectral detection on the yarn sample normally dyed in the same batch to obtain first spectral information $[x_i, y_i]$, where $x_i$ is a wave number sampling value, $y_i$ is a spectral information intensity, and i is a natural number from 1 to 400;

calculating a covariance by simulation through a Gaussian process kernel (RBF Kernel) of a following calculation formula I based on the first spectral information:

$$k = \sigma^2 \exp\left(-\frac{\|t_m - t_n\|^2}{2l^2}\right) \quad \text{(I)}$$

where $\sigma$ is 0.5, 1 is 1.0, $t_m$ corresponds to a value of $y_i$ when i=m, $t_n$ corresponds to a value of $y_i$ when i=n, and m and n are natural numbers from 1 to 400 respectively;

obtaining a plurality of pieces of continuous second spectral information $[x_j, y_j]$ for a yarn sample in a batch to be judged with a given wave number sampling step, and establishing a Gaussian process regression model according to the covariance, where the plurality of pieces of continuous second spectral information $[x_j, y_j]$ is a $2\times N_1$ matrix, where j=1, 2, . . . , $N_1$, and $N_1$ is a sampling number of the yarn sample in the batch to be judged and is a natural number greater than 200;

obtaining third spectrum information $[a_j, b_j]$ for a yarn sample to be detected, where the third spectrum information $[a_j, b_j]$ is a $2\times N_2$ matrix, $N_2$ is a sampling number of the yarn sample to be detected, and $N_2$ is equal to $N_1$;

performing a subtraction operation on the $2\times N_2$ matrix of the third spectral information $[a_j, b_j]$ and the $2\times N_1$ matrix of the second spectral information $[x_j, y_j]$ to obtain a $2\times N_3$ matrix $[u_j, v_j]$, where $N_3$ is equal to $N_1$ and $N_2$; and judging dyeing performance of the yarn sample to be detected according to a value of $v_j$.

According to a second aspect of the present disclosure, provided is an apparatus for prejudging yarn dyeing performance, including: a spectrum detection unit, a data preprocessing unit, a prejudgment unit and a control unit.

According to a third aspect of the present disclosure, provided is an electronic device, including:

at least one processing unit; and a storage unit in signal communication with the at least one processing unit;

where the storage unit stores an instruction executable by the at least one processing unit, to enable the at least one processing unit to execute the above method.

According to a fourth aspect of the present disclosure, provided is a computer-readable storage medium storing a computer instruction thereon, and the computer instruction is non-transitory and is used to cause a computer to execute the above method.

The technical solution provided in the present disclosure at least includes the following beneficial effects:

manual weaving and dyeing and color judgment only need to be performed in an initial production stage. Based on manual color judgment, the use of spectral detection and data simulation processing can achieve dynamic and complete detection of a yarn production process. The detection method is simple and convenient and can be used for online detection of production lines.

It should be understood that the content described in this part is not intended to identify critical or essential features of embodiments of the present disclosure, nor is it used to limit the scope of the present disclosure. Other features of the present disclosure will be easily understood through the following description.

BRIEF DESCRIPTION OF THE DRAWINGS

In accompanying drawings, same reference numbers represent same or similar parts or elements throughout the accompanying drawings, unless otherwise specified. These accompanying drawings are not necessarily drawn to scale. It should be understood that these accompanying drawings only depict some embodiments provided according to the present disclosure, and should not be considered as limiting the scope of the present disclosure.

DETAILED DESCRIPTION

The present disclosure will be described below in detail with reference to the accompanying drawings. The same reference numbers in the accompanying drawings represent elements with identical or similar functions. Although various aspects of the embodiments are shown in the accompanying drawings, the accompanying drawings are not necessarily drawn to scale unless specifically indicated.

In addition, in order to better illustrate the present disclosure, numerous specific details are given in the following specific implementations. Those having ordinary skill in the art should understand that the present disclosure may be performed without certain specific details. In some examples, methods, means, components and reagents well known to those having ordinary skill in the art are not described in detail, in order to highlight the subject matter of the present disclosure.

In the related art, a hosiery dyeing and judging method is usually used to test dyeing performance of fiber filament yarns. The common hosiery dyeing and judging method includes steps of knitting garters, preparing dye solution, dyeing, rinsing, drying and manual color judgment. This method involves many steps, consumes a long time, and has low efficiency, resulting in serious lag in a color judgment result. During a production process, a small number of randomly inspected samples make it easy for missed inspection to occur, and the manual color judgment process will be affected by the experience of the inspector, the test environment, etc., resulting in a change in the color judgment result.

In order to at least partially solve one or more of the above problems, an embodiment of the present disclosure provides a dyeing effect prediction method. Using the technical solution of the embodiment of the present disclosure, the dyeing grade of each batch of yarn spindles can be objectively predicted without dyeing, improving detection accuracy and detection efficiency.

The main types of yarns involved in the solution of the embodiments of the present disclosure may include one or more of partially oriented yarns (POY), fully drawn yarns (FDY), draw textured yarns (DTY) (or called low-elastic yarns), etc. For example, the types of yarns may specifically include polyester partially oriented yarns, polyester fully drawn yarns, polyester drawn yarns, polyester draw textured yarns, polyester staple fiber, etc.

Figure 1:
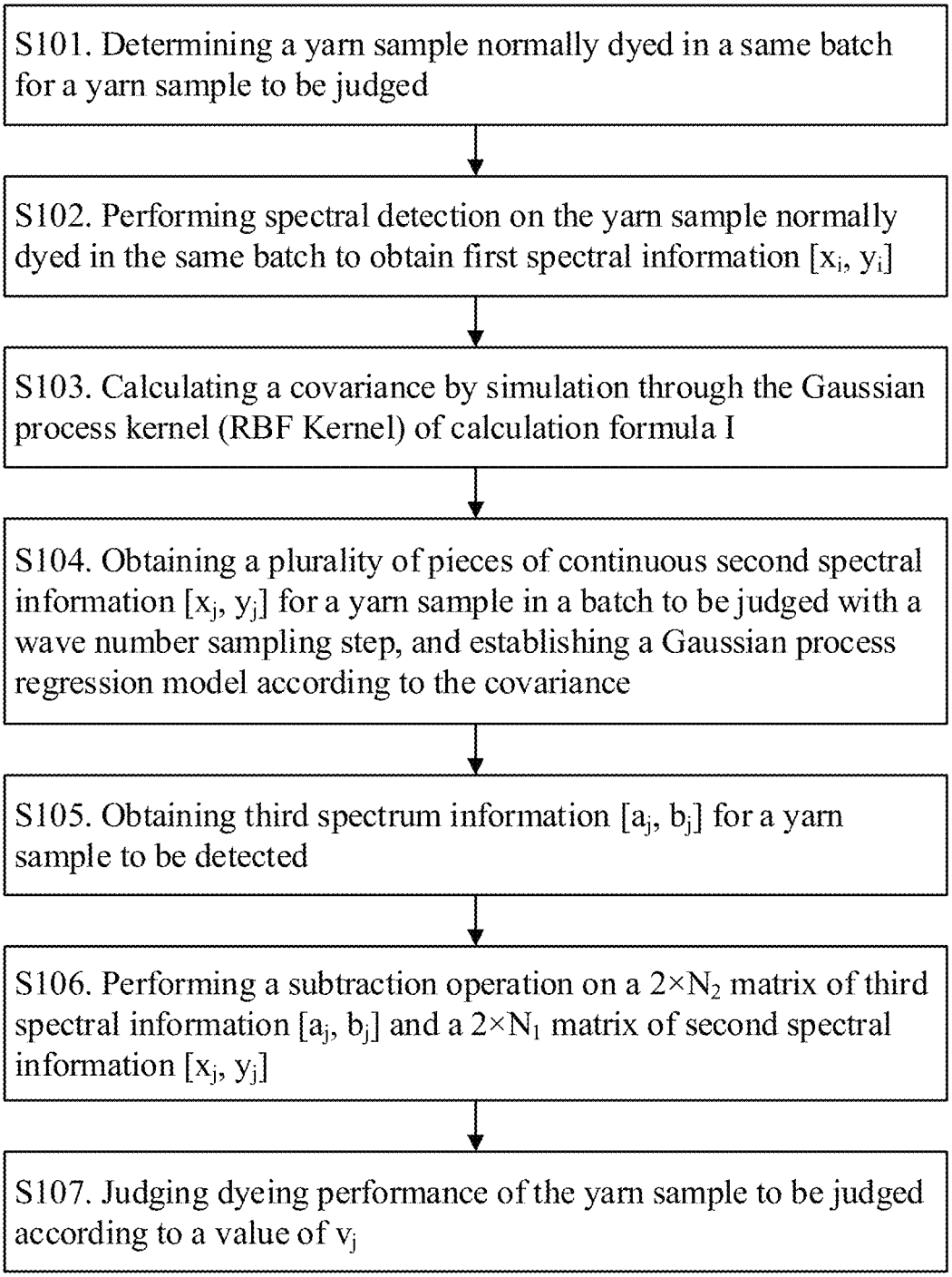
FIG. 1 is a schematic flow chart of a method for prejudging yarn dyeing performance according to an embodiment of the present disclosure.

FIG. 1 shows a method for prejudging yarn dyeing performance according to an embodiment of the present disclosure. As shown in FIG. 1, the method includes at least the following steps.

S101: A yarn sample normally dyed in a same batch is determined for a yarn sample to bejudged.

According to a specific embodiment, the yarn sample normally dyed in the same batch is manually judged by using the yarn sample to be judged through a hosiery dyeing method including garter knitting, dyeing and color judgment.

Figure 2:
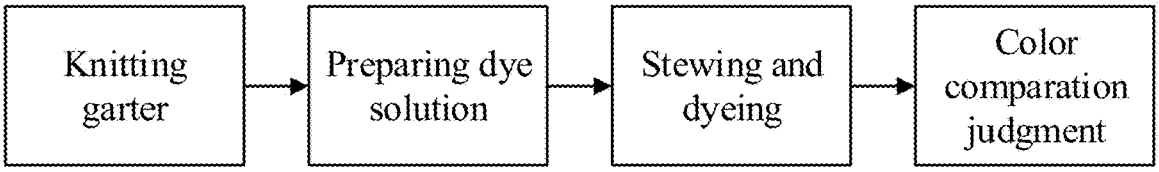
FIG. 2 is a schematic flow chart of a hosiery dyeing and judging method according to an embodiment of the present disclosure.

Specifically, referring to FIG. 2, the garter knitting method may be carried out according to the standard GB/T 6508-2001. The dyeing step includes preparing a dye solution. For example, a blue dye, a violet dye or a red dye may be used. The amount of dye may be selected according to the fineness specification of the yarn filament, for example, may be 0.6% to 1.5% of the weight of the garter; and preferably, may be 0.6% to 0.8% of the weight of the garter, or may be 0.8% to 1.2% of the weight of the garter, or may be 1.2% to 1.5% of the weight of the garter.

According to a specific embodiment, the above dyeing step further includes: placing a dyed garter in the dye solution at 60° C. to 90° C. and maintaining for a predetermined time, such as 10-20 min. Preferably, before the garter is placed, the pH of the dye solution is adjusted to be acidic, for example, to be less than 7 such as 5. The pH value of the dye solution may be adjusted by using a buffer system of an organic acid and its salt. For example, the pH value may be adjusted by using the buffer solution of acetic acid-sodium acetate or the buffer solution of citric acid-sodium citrate. Then, temperature of the dye solution is increased to a dyeing temperature and maintained for a period of time. The dyeing temperature may be 100° C. The dyeing step may be carried out in a dyeing device selected from a jet dyeing vat, a rope dyeing vat, and a high-temperature and high-pressure dyeing vat.

After being taken out of the dyeing device, the dyed garter is preferably washed with water and dehydrated for subsequent color judgment steps. Specifically, the garter is covered on a color judgment plate (such as a black and white plate), appropriate observation conditions are selected, and comparison with a standard color card is performed, to determine dyeing grade of the yarn.

The above observation conditions may, for example, include: a lighting condition, for example, referring to the method of FZ/T 01047-1997, the light source used is a D65 standard light source with illumination of 600 to 1000 lx; an incident angle of light on the garter surface, for example, an angle between the incident light and the garter surface may be 45°; an observation angle, which is approximately perpendicular to the garter surface; and an observation distance, which may be approximately 30-40 cm. If the observation is not clear, the incident angle of light may be adjusted to 70°, and the observation angle between the observation direction and the garter surface may be adjusted to 30°.

The dyeing grade may be judged as normal, dark and light according to the standard color card.

S102: Spectral detection is performed on the yarn sample normally dyed in the same batch to obtain first spectral information $[x_i, y_i]$. Here, $x_i$ is a wave number sampling value, $y_i$ is a spectral information intensity, and i is a natural number from 1 to 400.

The above spectrum may adopt Raman spectrum. Here, the Raman spectrum analysis method is based on the Raman scattering effect of a filament fiber structure. By analyzing a scattered spectrum with a frequency different from that of the incident light, spectral information on structure, vibration and rotation of fiber molecules is obtained, and various qualitative and quantitative analyses are performed. In the Raman spectrum analysis, a high-quality and high-intensity monochromatic laser beam is used to irradiate the surface of the fiber to be analyzed. Due to different microstructures of the fiber to be analyzed, the scattered lights form different scattering spectra (i.e., Raman spectra), for high-precision qualitative and quantitative analysis of fiber properties.

In contrast, an infrared spectrum analysis method uses an infrared radiation source to excite a sample to be detected, and identifies chemical bonds and vibration modes in a molecular structure by measuring intensities of absorption, scattering and transmission of infrared radiation in the material, to obtain an absorption spectrum (i.e. an infrared spectrum), thereby determining the structure of the molecule.

In comparison, since the Raman effect exists more widely and the excitation source used is high-purity and high-intensity laser, the signal in Raman spectrum analysis is purer, the signal-to-noise ratio is higher, the system is simpler, the layout is more flexible, and the environmental interference is less.

In the present disclosure, the filament to be detected may be a polyester fiber product with a crystalline structure, or a polyester fiber product with a non-crystalline structure. The polyester fiber product may be polyester filament yarns obtained by spinning and post-processing. The crystalline structure refers to a state in which polymers are orderly arranged in the fiber. In the crystalline structure, polymer chains are arranged with each other closely to form an orderly lattice structure. The fiber with the crystalline structure usually has higher crystallinity. Due to the orderly arrangement of molecules, the fiber with the crystalline structure is usually more stable and also have higher strength and hardness. The non-crystalline structure refers to a state in which polymers are disordered in the fiber without forming a regular lattice structure. In the non-crystalline structure, the polymer chains are relatively loose and are not obviously periodically arranged. During dyeing, the lattice structure usually cannot be dyed. The differences in dyeing indicators of fibers in the same type mainly stem from differences in fiber crystallinity (or degree of vitrification), crystal distribution, orientation degree, and end group concentration of the fibers. During the dyeing process, the dye molecules can only combine with the end groups of the non-crystalline part in the fibers. The more the dye molecules combine, the darker the dyed color will be, and vice versa.

The Raman spectrum analysis is sensitive to crystallinity, orientation degree and component concentration of the detected fiber sample. In a specific embodiment, multiple pieces of spectral information may be measured at multiple wave numbers within a wavenumber range from 500 $cm^{-1}$ to 3500 $cm^{-1}$ to form the Raman spectrum, for example, shown in FIG. 3.

In an embodiment of the present disclosure, step S102 includes performing spectral detection on a yarn spindle of the yarn determined to be normally dyed in step S101, to obtain a spectrogram and continuous spectral information $[x_i, y_i]$. Preferably, the spectrum information includes wave number sampling value $x_i$ (corresponding to the abscissa of the Raman spectrogram shown in FIG. 3) and the spectrum information intensity $y_i$ (corresponding to the ordinate of the Raman spectrogram shown in FIG. 3). Here, i is a natural number from 1 to 400, preferably, may be a natural number from 100 to 300, or may be a natural number from 200 to 400.

According to a specific embodiment, the wave number sampling step in the above step S102 may be 1 to 10 $cm^{-1}$, for example, 3 to 7 $cm^{-1}$, and preferably 5 $cm^{-1}$.

Specifically, in the method of the present disclosure, spectral detection is preferably performed downstream of a winding process of the yarn spindle, that is, a spectrometer is arranged on one side or downstream of a winder of a yarn production line. For example, the spectrometer may be arranged on a transfer device of the yarn spindle, so that spectral detection can be completed while the yarn spindle is wound or transferred. Preferably, measuring positions may be distributed on an annular side of the yarn spindle. For example, the yarn spindle may be rotated during test, so that measuring positions are distributed at different positions as much as possible, to improve accuracy of measurement.

On the other hand, spectral information obtained in this step includes a spectral intensity value rather than a specific structural feature or performance feature.

In the method of the present disclosure, the obtained spectral information includes the wave number sampling value and the spectral intensity value, rather than numerical information of a single physicochemical property. Since the obtained spectrogram is a comprehensive reflection of multiple factors such as chemical structure, crystallization state, orientation degree and glass transition temperature of the fiber and oil solution contained in the fiber, dyeing characteristic of the fiber may be reflected more accurately. In addition, the wave number sampling value and the spectral intensity value may be directly obtained from a spectral curve graph, avoiding method steps of complex parameter conversion and processing.

S103: A covariance is calculated by simulation through the Gaussian process kernel (RBF Kernel) of the following calculation formula I:

$$k = \sigma^2 \exp\left(-\frac{\|t_m - t_n\|^2}{2l^2}\right), \tag{I}$$

where, $\sigma$ is 0.5, 1 is 1.0, and $t_m$ and $t_n$ represent labels of dimensions and correspond to an m-th feature and an n-th feature. Here, $t_m$ corresponds to a value of $y_i$ when i=m, $t_n$ corresponds to a value of $y_i$ when i=n, and m and n are natural numbers from 1 to 400 respectively.

According to the above Gaussian process kernel (RBF Kernel), the more adjacent two features are in dimension, the higher the covariance coefficient between them is, and the more correlated the two features are; the farther the two features are apart, the smaller the covariance coefficient between them is, and the less correlated they are.

S104: A plurality of pieces of continuous second spectral information $[x_j, y_j]$ is obtained for a yarn sample in a batch to be judged with a wave number sampling step, and a Gaussian process regression model is established according to the covariance.

Here, the plurality of pieces of continuous second spectrum information $[x_j, y_j]$ is a $2\times N_1$ matrix. Here, $x_j$ is a wave number value of a j-th sampling point in a second spectrogram, and $y_j$ is spectral intensity of the j-th sampling point in the second spectrogram. Specifically, j=1, 2, . . . , $N_1$, and $N_1$ is the sampling number of the yarn sample in the batch to be judged and is a natural number greater than 200.

In order to make the degree of fitting of the above Gaussian process regression high, a higher sampling rate is preferably used, that is, a larger value of $N_1$ is selected. According to an embodiment, when the wave number step of sampling is 10 $cm^{-1}$, the sampling number N is 200. According to another embodiment, when the wave number step of sampling is 5 $cm^{-1}$, the sampling number N is 400. According to actual needs, other wave number steps may be selected, and corresponding sampling numbers are selected accordingly.

The above sampling process may be performed for one yarn spindle or a plurality of yarn spindles in the same batch. According to an embodiment, spectral scanning may be performed on one yarn spindle while it is being rotated, so that sampling points are evenly distributed on the surface of the circumferential side of the yarn spindle. According to another embodiment, spectral scanning may be performed on a plurality of yarn spindles wound in parallel on a winder, and sampling positions may be evenly distributed.

S105: Third spectrum information $[a_j, b_j]$ is obtained for a yarn sample to be detected. Here, the third spectral information $[a_j, b_j]$ is a $2\times N_2$ matrix, and $N_2$ is the sampling number of the yarn sample to be detected.

Here, $a_j$ is a wave number value of a j-th sampling point in a third spectrogram, and $b_j$ is spectral intensity of the j-th sampling point in the third spectrogram. Specifically, $j=1, 2, \ldots, N_1$, and $N_2$ is the sampling number of the yarn sample in the batch to be judged and is a natural number greater than 200. Preferably, $N_2$ is equal to $N_1$.

The spectral information matrices with the same size are obtained in the steps S104 and S105. That is, preferably, the sampling method for detecting the target yarn spindle is consistent with the sampling method for the Gaussian process regression model described above, to facilitate data processing in subsequent steps.

S106: A subtraction operation is performed on the $2\times N_2$ matrix of the third spectral information $[a_j, b_j]$ and the $2\times N_1$ matrix of the second spectral information $[x_j, y_j]$ to obtain a $2\times N_3$ matrix $[u_j, v_j]$, where $N_3$ is equal to $N_1$ and $N_2$.

The spectral information measured for the yarn sample to be detected (such as the yarn spindle to be detected) is compared with spectral information processed by the Gaussian process regression model to obtain a fluctuation amplitude of the spectral characteristic of the yarn sample to be detected, and further the fluctuation amplitude is used to measure dyeing performance of the yarn sample.

S107: The dyeing performance of the yarn sample to be detected is judged according to a value of $v_j$.

According to characteristics of the adopted spectral detection method and characteristics of the detected yarn, it is determined that the dyeing performance of the yarn is within a normal range when a variation amplitude of the spectral intensity is within 0.01.

Figure 3:
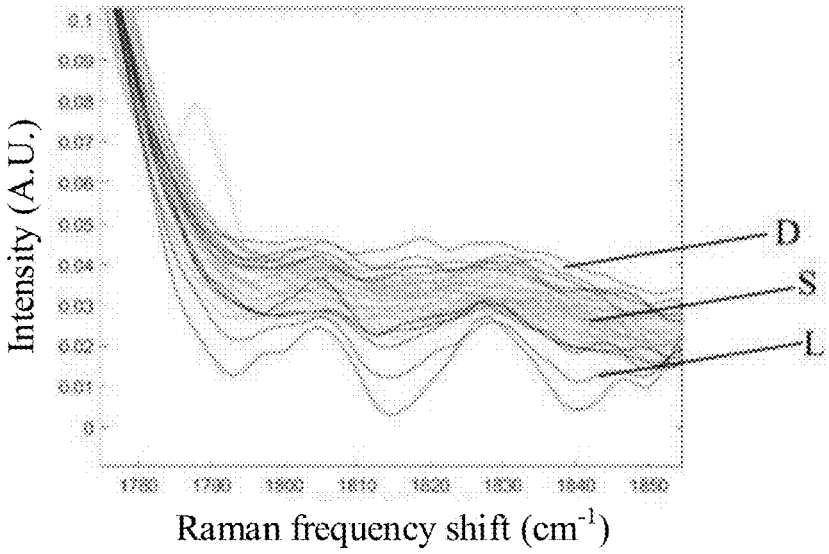
FIG. 3 is Raman spectrum of polyester filament yarns according to an embodiment of the present disclosure.

Referring to FIG. 3, according to a specific embodiment, when the value of $v_j$ is within an interval of $[-0.01, 0.01]$, it is determined that the yarn sample to be detected is normally dyed, as shown by the area S in FIG. 3.

According to another specific embodiment, when the value of $v_j$ is greater than 0.01, it is determined that the yarn sample to be detected is darkly dyed, as shown by the area D in FIG. 3. Preferably, when there are more than 3 values of $v_j$ greater than 0.01, it is determined that the yarn sample to be detected is darkly dyed.

According to yet another specific embodiment, when the value of $v_j$ is less than −0.01, it is determined that the yarn sample to be detected is lightly dyed, as shown by the area L in FIG. 3. Preferably, when there are more than 3 values of $v_j$ less than −0.01, it is determined that the yarn sample to be detected is lightly dyed.

As can be seen from the above, compared with the conventional infrared spectrum detection method in which the sampling number is usually 5-10, the sampling number is significantly larger (more than 200) in the method of the present disclosure, making the detection result more accurate and more conducive to preventing missed detection. Also, by using the Gaussian process regression model to process detection data, the spectral intensity value directly corresponds to dyeing characteristics of the yarn, saving a data conversion process while avoiding the phenomenon that the use of data of a single performance feature to measure the yarn dyeing performance is prone to deviation, so that the judgment result is more accurate, the detection process is simpler, the detection efficiency is higher, and this method is more suitable for online real-time detection of the production line.

Figure 4:
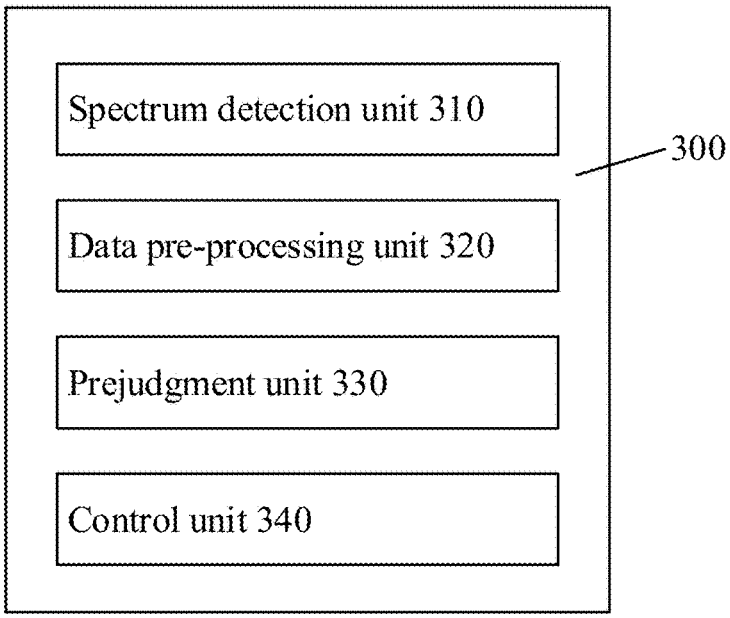
FIG. 4 is a structural schematic diagram of an apparatus for prejudging yarn dyeing performance according to an embodiment of the present disclosure.

Referring to FIG. 4, according to a second aspect of the present disclosure, an apparatus 300 for prejudging yarn dyeing performance is provided, including: a spectrum detection unit 310, a data pre-processing unit 320, a prejudgment unit 330 and a control unit 340.

The spectrum detection unit 310 is configured to perform spectral scanning on yarn samples to be detected that are qualified in color in the same batch according to set scanning parameters (such as a wave number step, quantity and distribution of scanning positions, etc.) to obtain a spectrogram, and send continuous spectrum information data to the data preprocessing unit 320.

The data preprocessing unit 320 obtains the continuous wave number and spectrum intensity data from the spectrum information data, and calculates a covariance through the Gaussian process kernel (RBF kernel) formula. The method for calculating the covariance through the Gaussian process kernel (RBF kernel) formula is as described above.

The prejudgment unit 330 is configured to obtain spectral information of multiple yarn samples to be judged from the spectral detection unit 310, and establish a Gaussian process regression model based on the above covariance; then obtain spectral information of a yarn sample to be detected from the spectral detection unit 310, perform a subtraction operation on it and a spectral information matrix of the Gaussian process regression model, and judge dyeing performance of the yarn sample to be detected based on data after the subtraction operation. Further, the prejudgment unit 330 sends a judgment result of the dyeing performance to the control unit 340.

The control unit 340 receives the judgment result from the prejudgment unit 330, and sends a transportation direction and a label of the yarn sample to be detected to the production line according to the judgment result, that is, a qualified product warehouse or an unqualified product warehouse.

According to a third aspect of the present disclosure, there is provided an electronic device, including one or more processing units; and a storage unit in signal communication with at least one processing unit. Here, the storage unit stores instructions (i.e., computer program) executable by the processing unit. The electronic device executes the above computer program, to enable the processing unit to execute the method described above.

The electronic device may also include a communication interface in communication with an external device for data interactive transmission.

The processing unit may be selected from a central processing unit, other general-purpose processors, a digital signal processor or an application-specific integrated circuit, etc. The general-purpose processor may be a microprocessor or any conventional processor, etc.

The storage unit may include one or more of a read-only memory, a random access memory and a non-volatile random access memory. The memory may be a volatile memory or a non-volatile memory, or may include both a volatile memory and a non-volatile memory.

According to a fourth aspect of the present disclosure, there is provided a computer-readable storage medium storing a computer instruction. Here, the computer instruction is non-transient and is used to cause the computer to execute the above method.

The above embodiments may be implemented in whole or in part by software, hardware, firmware or any combination thereof. When implemented by software, they may be implemented in the form of a computer program product in whole or in part. The computer program product includes one or more computer instructions. When the computer instructions are loaded and executed on a computer, processes or functions described in embodiments of the present disclosure are generated in whole or in part. The computer may be a general-purpose computer, a special-purpose computer, a computer network, or other programmable device. The computer instructions may be stored in a computer readable storage medium or transmitted from one computer readable storage medium to another computer readable storage medium. For example, the computer instructions may be transmitted from one website, computer, server or data center to another website, computer, server or data center in a wired (e.g., coaxial cable, optical fiber, digital subscriber line (DSL)) or wireless (e.g., infrared, Bluetooth, microwave, etc.) manner. The computer readable storage medium may be any available medium that can be accessed by a computer, or a data storage device such as a server or data center that is integrated with one or more available media. The available media may be magnetic media (for example, floppy disk, hard disk, magnetic tape), optical media (for example, digital versatile disc (DVD)), or semiconductor media (for example, solid state disk (SSD)), etc. It is worth noting that the computer readable storage medium mentioned in the present disclosure may be a non-volatile storage medium, in other words, may be a non-transitory storage medium.

For descriptions of specific functions and examples of modules and sub-modules of the apparatus of the embodiments of the present disclosure, reference may be made to relevant descriptions of corresponding steps in the above method embodiments, which are not repeated here.

Those having ordinary skill in the art can understand that all or some of steps for implementing the above embodiments may be completed by hardware, or may be completed by instructing related hardware through a program. The program may be stored in a computer readable storage medium. The above storage medium may be a read-only memory, a magnetic disk or an optical disk, etc.

In descriptions of the embodiments of the present disclosure, the descriptions with reference to the terms "an embodiment", "some embodiments", "example", "specific example" or "some examples", etc. means that specific features, structures, materials or characteristics described in conjunction with the embodiments or examples are included in at least one embodiment or example of the present disclosure. Moreover, specific features, structures, materials or characteristics described may be combined in a suitable manner in any one or more embodiments or examples. In addition, those skilled in the art can integrate and combine different embodiments or examples and features of different embodiments or examples described in this specification without conflicting with each other.

In the descriptions of the embodiments of the present disclosure, "/" represents or, unless otherwise specified. For example, A/B may represent A or B. The term "and/or" herein only describes an association relation of associated objects, which indicates that there may be three kinds of relations, for example, A and/or B may indicate that only A exists, or both A and B exist, or only B exists.

In the descriptions of the embodiments of the present disclosure, the terms "first" and "second" are only for purpose of description, and cannot be construed to indicate or imply the relative importance or implicitly point out the number of technical features indicated. Therefore, the feature defined with "first" or "second" may explicitly or implicitly include one or more features. In the descriptions of the embodiments of the present disclosure, "multiple" means two or more, unless otherwise specified.

The above descriptions are only example embodiments of the present disclosure and not intended to limit the present disclosure. Any modifications, equivalent replacements, improvements and others made within the spirit and principle of the present disclosure shall be contained in the protection scope of the present disclosure.

What is claimed is:

1. A method for judging yarn dyeing performance, comprising:

determining a yarn sample normally dyed in a batch for a yarn to be judged;

performing spectral detection on the yarn sample normally dyed in the batch to obtain first spectral information $[x_i, y_i]$, wherein $x_i$ is a wave number sampling value, $y_i$ is a spectral information intensity, and i is a natural number from 1 to 400;

calculating a covariance by simulation through a Gaussian process kernel (RBF Kernel) of a following calculation formula I based on the first spectral information:

$$k = \sigma^2 \exp\left(-\frac{\|t_m - t_n\|^2}{2l^2}\right) \quad \text{(I)}$$

wherein $\sigma$ is 0.5, 1 is 1.0, $t_m$ corresponds to a value of $y_i$ in a case of i=m, $t_n$ corresponds to the value of $y_i$ in a case of i=n, and m and n are natural numbers from 1 to 400 respectively;

obtaining a plurality of pieces of continuous second spectral information $[x_j, y_j]$ for the yarn sample in the batch to be judged with a wave number sampling step, and establishing a Gaussian process regression model according to the covariance, wherein the plurality of pieces of continuous second spectral information $[x_j, y_j]$ is a $2\times N_1$ matrix, wherein j=1, 2, . . . , $N_1$, and $N_1$ is a sampling number of the yarn sample in the batch to be judged and is a natural number greater than or equal to 200;

obtaining third spectral information $[a_j, b_j]$ for the yarn sample to be detected, wherein the third spectral information $[a_j, b_j]$ is a $2\times N_2$ matrix, $N_2$ is the sampling number of the yarn sample to be detected, and $N_2$ is equal to $N_1$;

performing a subtraction operation on the $2\times N_2$ matrix of the third spectral information $[a_j, b_j]$ and the $2\times N_1$ matrix of the plurality of pieces of continuous second spectral information obtained by establishing the Gaussian process regression model, to obtain a $2\times N_3$ matrix $[u_j, v_j]$, wherein $N_3$ is equal to $N_1$ and $N_2$; and judging dyeing performance of the yarn sample to be detected according to a value of $v_j$.

2. The method of claim 1, wherein judging the dyeing performance of the yarn sample to be detected according to the value of $v_j$ comprises: in a case of the value of $v_j$ is within an interval [−0.01, 0.01], judging that the yarn sample to be detected is normally dyed; or, in a case of the value of $v_j$ is greater than 0.01, judging that the yarn sample to be detected is darkly dyed; or, in a case of the value of $v_j$ is less than −0.01, judging that the yarn sample to be detected is lightly dyed.

3. The method of claim 1, wherein spectral information adopts a Raman spectrum.

4. The method of claim 1, wherein the wave number sampling step is 2 to 10 $cm^{-1}$ and the sampling number is 200 to 400 in the step of establishing the Gaussian process regression model.

5. The method of claim 4, wherein in a case of the wave number sampling step is 10 $cm^{-1}$, the sampling number $N_1$ is 200; or in a case of the wave number sampling step is 5 $cm^{-1}$, the sampling number $N_1$ is 400.

6. The method of claim 1, wherein the yarn sample normally dyed in the batch is manually judged by using the yarn sample to be judged through a hosiery dyeing method comprising garter knitting, dyeing and color judgment.

7. The method of claim 1, wherein the yarn is selected from partially oriented yarns, fully drawn yarns and draw textured yarns.

8. An electronic device, comprising:

at least one processing unit; and a storage unit in signal communication with the at least one processing unit;

wherein the storage unit stores an instruction executable by the at least one processing unit, to enable the at least one processing unit to execute:

determining a yarn sample normally dyed in a batch for a yarn to be judged;

performing spectral detection on the yarn sample normally dyed in the batch to obtain first spectral information $[x_i, y_i]$, wherein $x_i$ is a wave number sampling value, $y_i$ is a spectral information intensity, and i is a natural number from 1 to 400;

calculating a covariance by simulation through a Gaussian process kernel (RBF Kernel) of a following calculation formula I based on the first spectral information:

$$k = \sigma^2 \exp\left(-\frac{\|t_m - t_n\|^2}{2l^2}\right) \quad \text{(I)}$$

wherein σ is 0.5, 1 is 1.0, $t_m$ corresponds to a value of $y_i$ in a case of i=m, $t_n$ corresponds to the value of $y_i$ in a case of i=n, and m and n are natural numbers from 1 to 400 respectively;

obtaining a plurality of pieces of continuous second spectral information $[x_j, y_j]$ for the yarn sample in the batch to be judged with a wave number sampling step, and establishing a Gaussian process regression model according to the covariance, wherein the plurality of pieces of continuous second spectral information $[x_j, y_j]$ is a $2\times N_1$ matrix, wherein j=1, 2, . . . , $N_1$, and Ni is a sampling number of the yarn sample in the batch to be judged and is a natural number greater than or equal to 200;

obtaining third spectral information $[a_j, b_j]$ for the yarn sample to be detected, wherein the third spectral information $[a_j, b_j]$ is a $2\times N_2$ matrix, $N_2$ is a sampling number of the yarn sample to be detected, and $N_2$ is equal to $N_1$;

performing a subtraction operation on the $2\times N_2$ matrix of the third spectral information $[a_j, b_j]$ and the $2\times N_1$ matrix of the plurality of pieces of continuous second spectral information obtained by establishing the Gaussian process regression model, to obtain a $2\times N_3$ matrix $[u_j, v_j]$, wherein $N_3$ is equal to $N_1$ and $N_2$; and judging dyeing performance of the yarn sample to be detected according to a value of $v_j$.

9. The electronic device of claim 8, wherein judging the dyeing performance of the yarn sample to be detected according to the value of $v_j$ comprises: in a case of the value of vi is within an interval [−0.01, 0.01], judging that the yarn sample to be detected is normally dyed; or, in a case of the value of $v_j$ is greater than 0.01, judging that the yarn sample to be detected is darkly dyed; or, in a case of the value of $v_j$ is less than −0.01, judging that the yarn sample to be detected is lightly dyed.

10. The electronic device of claim 8, wherein spectral information adopts a Raman spectrum.

11. The electronic device of claim 8, wherein the wave number sampling step is 2 to 10 $cm^{-1}$ and the sampling number is 200 to 400 in the step of establishing the Gaussian process regression model.

12. The electronic device of claim 11, wherein in a case of the wave number sampling step is 10 $cm^{-1}$, the sampling number $N_1$ is 200; or in a case of the wave number sampling step is 5 $cm^{-1}$, the sampling number $N_1$ is 400.

13. The electronic device of claim 8, wherein the yarn sample normally dyed in the batch is manually judged by using the yarn sample to be judged through a hosiery dyeing method comprising garter knitting, dyeing and color judgment.

14. The electronic device of claim 8, wherein the yarn is selected from partially oriented yarns, fully drawn yarns and draw textured yarns.

15. A non-transitory computer-readable storage medium storing a computer instruction thereon, wherein the computer instruction is non-transitory and is used to cause a computer to execute:

determining a yarn sample normally dyed in a batch for a yarn to be judged;

performing spectral detection on the yarn sample normally dyed in the batch to obtain first spectral information $[x_i, y_i]$, wherein $x_i$ is a wave number sampling value, $y_i$ is a spectral information intensity, and i is a natural number from 1 to 400;

calculating a covariance by simulation through a Gaussian process kernel (RBF Kernel) of a following calculation formula I based on the first spectral information:

$$k = \sigma^2 \exp\left(-\frac{\|t_m - t_n\|^2}{2l^2}\right) \quad \text{(I)}$$

wherein σ is 0.5, 1 is 1.0, $t_m$ corresponds to a value of $y_i$ in a case of i=m, $t_n$ corresponds to the value of $y_i$ in a case of i=n, and m and n are natural numbers from 1 to 400 respectively;

obtaining a plurality of pieces of continuous second spectral information $[x_j, y_j]$ for the yarn sample in the batch to be judged with a wave number sampling step, and establishing a Gaussian process regression model according to the covariance, wherein the plurality of pieces of continuous second spectral information $[x_j, y_j]$ is a $2\times N_1$ matrix, wherein j=1, 2, . . . , $N_1$, and $N_1$ is a sampling number of the yarn sample in the batch to be judged and is a natural number greater than or equal to 200;

obtaining third spectral information $[a_j, b_j]$ for the yarn sample to be detected, wherein the third spectral information $[a_j, b_j]$ is a $2\times N_2$ matrix, $N_2$ is a sampling number of the yarn sample to be detected, and $N_2$ is equal to $N_1$;

performing a subtraction operation on the $2\times N_2$ matrix of the third spectral information $[a_j, b_j]$ and the $2\times N_1$ matrix of the plurality of pieces of continuous second spectral information obtained by establishing the Gaussian process regression model, to obtain a $2\times N_3$ matrix $[u_j, v_j]$, wherein $N_3$ is equal to $N_1$ and $N_2$; and judging dyeing performance of the yarn sample to be detected according to a value of $v_j$.

16. The non-transitory computer-readable storage medium of claim 15, wherein judging the dyeing performance of the yarn sample to be detected according to the value of $v_j$ comprises: in a case of the value of $v_j$ is within an interval [−0.01, 0.01], judging that the yarn sample to be detected is normally dyed; or, in a case of the value of $v_j$ is greater than 0.01, judging that the yarn sample to be detected is darkly dyed; or, in a case of the value of $v_j$ is less than −0.01, judging that the yarn sample to be detected is lightly dyed.

17. The non-transitory computer-readable storage medium of claim 15, wherein spectral information adopts a Raman spectrum.

18. The non-transitory computer-readable storage medium of claim 15, wherein the wave number sampling step is 2 to 10 $cm^{-1}$ and the sampling number is 200 to 400 in the step of establishing the Gaussian process regression model.

19. The non-transitory computer-readable storage medium of claim 18, wherein in a case of the wave number sampling step is 10 $cm^{-1}$, the sampling number $N_1$ is 200; or in a case of the wave number sampling step is 5 $cm^{-1}$, the sampling number $N_1$ is 400.

20. The non-transitory computer-readable storage medium of claim 15, wherein the yarn sample normally dyed in the batch is manually judged by using the yarn sample to be judged through a hosiery dyeing method comprising garter knitting, dyeing and color judgment.

* * * * *